US009498028B2

(12) United States Patent
Caspi et al.

(10) Patent No.: US 9,498,028 B2
(45) Date of Patent: Nov. 22, 2016

(54) JEWELRY CLASP

(71) Applicant: Alex Toys, LLC, Northvale, NJ (US)

(72) Inventors: Liah Caspi, Closter, NJ (US); Owen Keating, Manhattan, NY (US)

(73) Assignee: Alex Toys, LLC, Fairfield, NJ (US)

( * ) Notice: Subject to any disclaimer, the term of this patent is extended or adjusted under 35 U.S.C. 154(b) by 200 days.

(21) Appl. No.: 14/332,424

(22) Filed: Jul. 16, 2014

(65) Prior Publication Data

US 2016/0015135 A1 Jan. 21, 2016

(51) Int. Cl.
*A44C 5/20* (2006.01)
*A44C 5/18* (2006.01)

(52) U.S. Cl.
CPC ..... *A44C 5/185* (2013.01); *A44C 5/2019* (2013.01)

(58) Field of Classification Search
None
See application file for complete search history.

(56) References Cited

U.S. PATENT DOCUMENTS

| | | | | |
|---|---|---|---|---|
| 2,266,074 A | | 12/1941 | Rauer | |
| 2,586,758 A | | 2/1952 | Zerr | |
| 3,120,042 A | | 2/1964 | Speranza et al. | |
| 3,247,560 A | | 4/1966 | Speranza et al. | |
| 3,247,561 A | | 4/1966 | Speranza et al. | |
| 4,527,316 A | | 7/1985 | Murphy | |
| 5,509,181 A | * | 4/1996 | Yuuki | A44B 19/262 24/116 A |
| 5,653,009 A | * | 8/1997 | Kassardjian | A44C 5/2061 24/616 |
| 6,880,363 B2 | | 4/2005 | Ma | |
| 7,350,376 B2 | * | 4/2008 | Couling | A44C 5/2095 63/3 |
| 8,499,582 B1 | | 8/2013 | Carter | |
| 2003/0080572 A1 | * | 5/2003 | So | E05B 83/24 292/336.3 |

* cited by examiner

*Primary Examiner* — Jack W Lavinder
(74) *Attorney, Agent, or Firm* — Howson & Howson LLP

(57) ABSTRACT

A clasp for use in making jewelry comprises an elongated hollow tube having an opening at least at one of its ends and an elongated, Z-shaped slot having a first section extending from the open end of the tube to a first intermediate location, a second section extending approximately circumferentially from the first intermediate location to a second intermediate location, and a third section extending from the second intermediate location to a third intermediate location. Flexible decorative strands of material, having enlarged ends larger than the slot, can be slid into the opening of the slot and into the third section, where they remain unless deliberate manipulations are undertaken to remove the strands.

5 Claims, 2 Drawing Sheets

JEWELRY CLASP

FIELD OF THE INVENTION

This invention relates to jewelry, and more specifically to a clasp for use in making articles of jewelry such as bracelets, from flexible strands of decorative cord or like material.

BACKGROUND OF THE INVENTION

Making home-made jewelry has become popular among young women, especially those in their teens and pre-teens. Bracelets, and necklaces, for example, can be made from various materials, such as strands of beads, cords of yarn or plastics, metal chains, and many other materials. Typically, the bracelet or necklace is made up of several, e.g., three or more, such strands arranged in parallel to one another. To connect the opposite ends of the parallel array of strands to each other, each end of the parallel array of strands is typically fastened to a clasp. The two clasps are releasably connectible to each other so that the bracelet or necklace can be conveniently worn and removed.

Typical jewelry clasps are described in the following U.S. Pat. Nos:

U.S. Pat. No. 2,266,074, granted Dec. 16, 1941,
U.S. Pat. No. 2,586,758, granted Feb. 19, 1952,
U.S. Pat. No. 3,120,042, granted Feb. 4, 1964,
U.S. Pat. No. 3,247,560, granted Apr. 26, 1966,
U.S. Pat. No. 3,247,561, granted Apr. 26, 1966,
U.S. Pat. No. 4,527,316, granted Jul. 9, 1985,
U.S. Pat. No. 6,880,363, granted Apr. 19, 2005, and
U.S. Pat. No. 8,499,582, granted Aug. 6, 2013.

These clasps provide for connection of the ends of necklaces and bracelets composed of plural strands, but are more suitable for use by adults, and generally lack the ability to accommodate a broad variety of kinds of strands.

There is a need for an inexpensive, versatile, and easy to use clasp to enable young persons to make their own bracelets, necklaces and similar articles.

SUMMARY OF THE INVENTION

The clasp in accordance with the invention comprises an elongated hollow tube having first and second ends, and an opening at least at the first end. The tube is defined by a cylindrical wall having a circumferential outer surface and a Z-shaped slot forming an opening from the interior of the tube to the exterior thereof. The slot extends from the first end of the tube to a location adjacent the second end of the tube.

More specifically, the hollow tube is elongated along a longitudinal direction, and its first and second opposite ends are separated from each other along the longitudinal direction. The tube comprises a circumferential wall having internal and external surfaces, and a longitudinal internal bore defined by the internal surface. The bore has an opening at the first end of the tube, and the bore extends longitudinally from the opening at least to a location adjacent the second end. The slot forms a continuous elongated opening through the wall from the internal surface to the external surface of the wall, and extends from the first end of the tube at least to a location adjacent the second end. The slot has minimum and maximum widths and an entry formed at the first end of the tube. The slot comprises a first slot section extending longitudinally from the entry to a first intermediate location between the first and second ends of the tube, a second section extending from the first intermediate location to a second intermediate location between the first and second ends. The first and second intermediate locations are both closer to the first end than to the second end. A third section of the slot extends longitudinally from the second intermediate location to an end surface at a third intermediate location. The third intermediate location is closer to the second end than to the first end, and the first and third sections are circumferentially displaced from each other.

Plural flexible strands, each having a thickness smaller than the minimum width of the slot and an enlarged end having a thickness larger than the maximum width of the slot, can be slid through the first and second sections into positions in which they extend through the third section of the slot, while their enlarged ends are passed through the opening at the first end of the tube and brought to positions inside the longitudinal internal bore of said tube and adjacent the third section of the slot.

The second intermediate location is preferably at least as close as the first intermediate location to the first end of the hollow tube, and can be closer than the first intermediate location to the first end of the hollow tube so that the second section forms acute angles with the first and third sections.

Preferably each of the three section of the slot is elongated, and the slot has a uniform width.

The end surface of the third section of the slot can be constituted by a closed end of the third section.

A fastening loop can be attached to the external surface of the circumferential wall at a location midway between the first and second ends and diametrically opposite the third section of the slot.

An article of jewelry can be made using two of the above-described elongated hollow tubes and a plurality of flexible strands each having enlargements at both ends for connection to the third slot section of the respective tubes. A releasable connection can be provided to connecting the two tubes to each other in parallel relationship, so that the clasps, the releasable connection and the flexible strands form a closed loop.

DETAILED DESCRIPTION OF THE PREFERRED EMBODIMENTS

Figure 1:
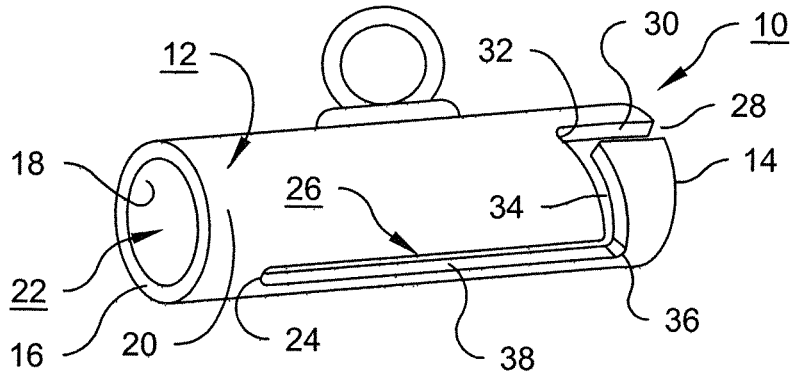
FIG. 1 is an oblique perspective view of a clasp according to the invention, showing a side and one end thereof.
Figure 2:
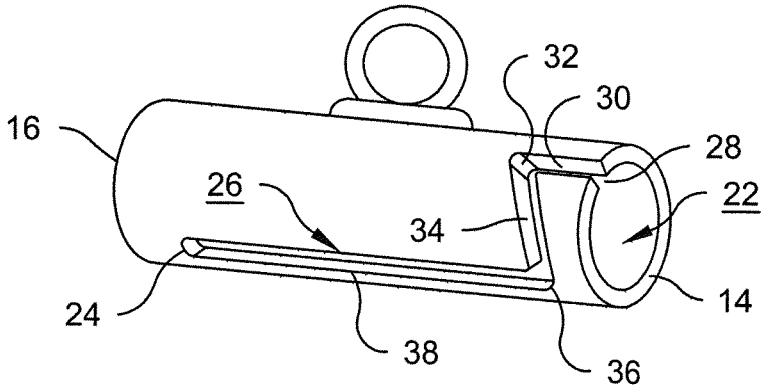
FIG. 2 is an oblique perspective view of the clasp showing the opposite end thereof.

As shown in FIGS. 1 and 2, the clasp 10 comprises a hollow tube 12, elongated along a longitudinal direction and having first and second opposite ends, 14 and 16 respectively, separated from each other along the longitudinal direction. The tube comprises a circumferential wall having and internal surface 18 and an external surface 20, and a longitudinal internal bore 22 defined by the internal surface. The internal bore 22 has an opening at the first end 14 of the tube and extends longitudinally from the opening at least to a location 24 adjacent the second end 16. In the embodiment shown, the bore 2 extends all the way through the tube, and has openings at both ends. A slot 26 forms a continuous elongated opening through the wall from the internal surface to the external surface. This opening extends from the first end 14 of the tube at least to location 24 adjacent the second end 16 of the tube.

The slot can be of uniform width, but the width of the slot does not need to be strictly uniform. Thus, the slot may have a minimum width and a maximum width. The slot has an entry 28 formed at the first end 14 of the tube, and comprises a first slot section 30, extending longitudinally from the entry 28 to a first intermediate location 32 between the first and second ends of the tube, a second section 34, extending from the first intermediate location 32 to a second intermediate location 36 between the first and second ends of the tube, and a third section 38, extending longitudinally from the second intermediate location 36 to an end surface at location 24, which is a third intermediate location.

The first and second intermediate locations 32 and 36 are both closer to the first end 14 of the tube than to the second end 16, and the third intermediate location 24 is closer to the second end 16 of the tube than to the first end 14.

Because the first and third sections of the slot 30 and 38 are circumferentially displaced from each other and connected by the second section 34, the slot is Z-shaped. Preferably the shape of the slot is such that the second intermediate location 36 is at least as close as the first intermediate location 32 to the first end 14 of the tube. If the distance from intermediate location 32 to end 14 of the tube exceeds the distance from intermediate location 36 to the end 14 of the tube by the width of the second slot section 34, the intermediate section 34 of the slot can be strictly circumferential. Ideally, however, the second intermediate location 36 is still closer than the first intermediate location 32 to said first end 14 of the tube, so that the first and third sections 30 and 38 form acute angles, e.g., angles of about 80°, with the second section 34, as shown in FIGS. 1 and 2.

Figure 3:
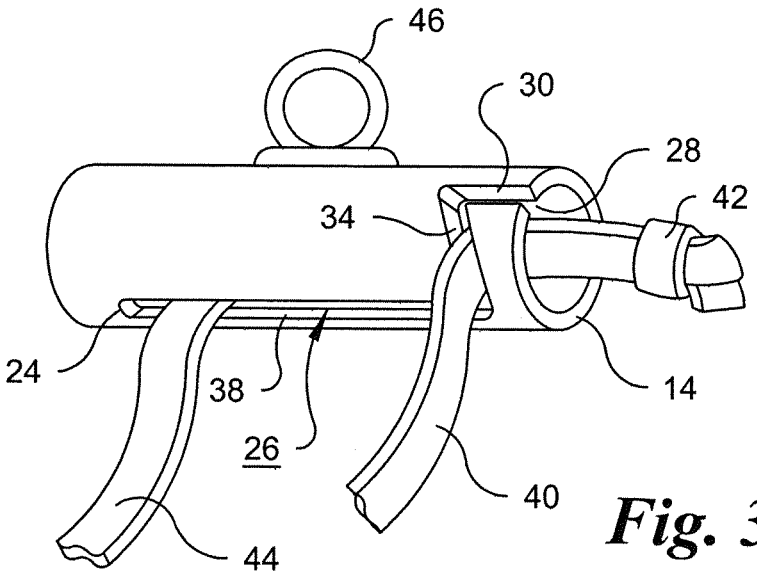
FIG. 3 is an oblique perspective view corresponding to FIG. 2, illustrating the manner in which a flexible strand is attached to the clasp.

In FIG. 2, a flexible strand 40, is shown being engaged with the slot 26. In this case, the flexible strand 40 is a length of flexible plastics material having an oblong rectangular cross-sectional shape and a width, measured in the direction of smaller dimension of the rectangular cross-section, that is smaller than the minimum width of the slot 26. A simple overhand knot 42 is formed at an end of the flexible strand 40 so that the strand has an enlarged end with a thickness larger than the maximum width of the slot 26. As shown in FIG. 3, the strand is slid through the entry 28 and through the first section of the slot into the second section, with the enlarged end formed by the knot positioned so that the strand extends from the exterior of the tube, inwardly through the slot, to the enlarged end. The strand can then be moved into the third section of the slot, and the enlarged end can be pulled inward through the opening at the first end 14 of the tube. By manually bending the strand 40 so that it passes around the acute angles of the slot, the strand 40 can be slid into a position adjacent a similar strand 44 previously engaged with the tube in a similar manner. A series of strands can be engaged with the tube until the third section 38 of the slot is filled, or nearly filled. The enlarged ends of the strands, which are larger than the maximum width of the third section 38 of the slot, are positioned inside the bore of the tube adjacent the third slot section 38, and prevent the strands from being pulled out through the third slot section.

The second slot section 34, which extends from slot section 38 to slot section 30, which is circumferentially displaced from slot section 34, prevents inadvertent disengagement of the strands from the tube by requiring, for removal, a special manipulation of the strands in which they are moved longitudinally from slot section 38 into slot section 34, and then through slot section 34 to slot section 30 in a direction having a circumferential component. Thus when the strands are in place, they are confined between the second section 34 of the slot, and the closed end surface of the third slot section at the third intermediate location 24, and inadvertent removal of the strands form the slot is effectively prevented.

The strands, of course, need not be plastic strands having elongated rectangular cross-sectional shapes. Lengths of yarn having knotted ends, or any of various other kinds of strands, for example, beaded strings or beaded chains, can be used. In the case of a beaded string or chain, an endmost bead can serve as the enlargement at the end of the strand, that prevents the strand from being pulled out through the third slot section 38. The Z-shape of the slot will prevent accidental disengagement of the strands from the tubular clasps.

Although the third section 38 of the slot in the embodiment shown in FIGS. 1-4 has a closed end at location 24, the advantages of the invention can be realized in alternative embodiments in which the slot has entries at both ends of the tube, two first slot sections corresponding to slot section 30 adjacent the opposite ends of the tube, two second slot sections corresponding to slot section 34, and a single third slot section corresponding to slot section 38. In this case, the end surfaces that limit longitudinal sliding of the strands, are side walls of the two second slot sections instead of closed ends corresponding to the closed end of slot section 38 at location 24.

FIG. 3 also shows a fastening loop 46 attached to the external surface of the circumferential wall of the tube at a location preferably midway between the first and second ends 14 and 16 of the tube and diametrically opposite the third slot section 38.

Figure 4:
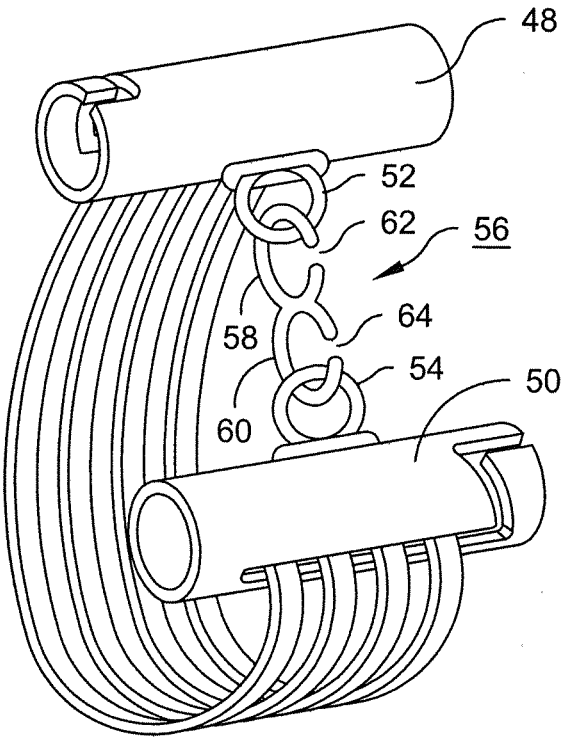
FIG. 4 is a perspective view showing an assembly composed of two clasps linked together in parallel relationship and an array of flexible strands extending from one clasp to the other to form a bracelet.

As shown in FIG. 4, two clasps 48 and 50, of the kind illustrated in FIGS. 1-3, can be utilized to make a bracelet. The fastening loops 52 and 54 of the respective clasps can be connected to each other by a link 56 composed of two integrally connected, resilient, wire loops 58 and 60, having gaps 62 and 64, which have a width slightly smaller than the width of the wire of the loops. The resilience of the link and the dimensional relationship of the gaps to the loop wire allow the link to be snapped onto the loops, and to be disengaged from the loops manually.

As mentioned above, the slotted tubular clasps as described above can be used to make bracelets from a wide variety of materials. The size of the bracelet depends on the lengths of the strands that extend from one clasp to the other. With sufficiently long strands of material, the clasps can also be used to make necklaces and even decorative belts. The clasps can be used to make an article of jewelry using two or more strands of different kinds of material, for example a bracelet made from strands of beads and yarns disposed side-by-side in an alternating arrangement.

The clasps can also be re-used. For example, if the strands of an article of jewelry made from a pair of clasps are damaged, or the user simply desires to make a new article of jewelry, she can easily remove the existing strands and replace them with new strands, strands of other materials, or strands of a different length.

What is claimed is:

1. A clasp for use in making jewelry comprising a hollow tube elongated along a longitudinal direction and having first and second opposite ends separated from each other along said longitudinal direction, said tube comprising a circumferential wall having internal and external surfaces, and a longitudinal internal bore defined by said internal surface, said bore having an opening at said first end of the tube and extending longitudinally from said opening at least to a location adjacent said second end, a slot forming a continuous elongated opening through said wall from said internal surface to said external surface, and extending from said first end at least to said location adjacent said second end, said slot having minimum and maximum widths and an entry formed at said first end, and said slot comprising a first slot section extending longitudinally from said entry to a first intermediate location between said first and second ends, a second section extending from said first intermediate location to a second intermediate location between said first and second ends, said first and second intermediate locations both being closer to said first end than to said second end, and a third section extending longitudinally from said second intermediate location to an end surface at a third intermediate location, said third intermediate location being closer to said second end than to said first end, and said first and third sections being circumferentially displaced from each other, whereby plural flexible strands, each having a thickness smaller than the minimum width of said slot and an enlarged end having a thickness larger than the maximum width of said slot, can be slid through said first and second sections into positions in which they extend through said third section of the slot, while their enlarged ends are passed through said opening at the first end of the tube and brought to positions inside said longitudinal internal bore of said tube and adjacent said third section of said slot, said clasp including a fastening loop attached to the external surface of said circumferential wall at a location midway between said first and second ends and diametrically opposite said third section of the slot.

2. An article of jewelry comprising first and second elongated hollow tubes, each tube having first and second ends and an opening at least at said first end thereof, each said tube being defined by a cylindrical wall, said cylindrical wall having a circumferential outer surface and a Z-shaped slot forming an opening from the interior of the tube to the exterior thereof, said slot extending from said first end of the tube to a location adjacent said second end of the tube, and being composed of a first section extending longitudinally from said first end to a first intermediate location, a second section extending from said first intermediate location to a second intermediate location, and a third section extending longitudinally from said second intermediate location to a third intermediate location adjacent said second end of the tube, said first and third sections being circumferentially displaced from each other, a plurality of flexible strands each having first and second ends and an enlargement at both ends thereof, each said enlargement being larger than the circumferential width of the third section of each said slot, the enlargements at the first ends of said flexible strands being located within the interior of said first tube, the enlargements at the second ends of said flexible strands being located within the interior of said second tube, and said strands extending through the third sections of the slots in each of said first and second tubes, a releasable connection connecting said tubes to each other in parallel relationship, whereby said clasps, said releasable connection and said flexible strands form a closed loop.

3. The article of jewelry according to claim 2, in which said second intermediate location is at least as close as said first intermediate location to said first end of the tube.

4. The article of jewelry according to claim 2, in which said second intermediate location is closer than said first intermediate location to said first end of the tube.

5. The article of jewelry according to claim 2, in which said releasable connection comprises a first fastening loop attached to the external surface of said first tube at a location midway between the first and second ends of said first tube and diametrically opposite said third section of the slot of said first tube, a second fastening loop attached to the external surface of said second tube at a location midway between the first and second ends of said second tube and diametrically opposite said third section of the slot of said second tube, said first and second loops being releasably connected to each other.

* * * * *